US009632480B2

(12) United States Patent
Yamauchi et al.

(10) Patent No.: US 9,632,480 B2
(45) Date of Patent: Apr. 25, 2017

(54) IMAGE FORMING SYSTEM, INTERMEDIATE CONVEYING APPARATUS, AND ADJUSTING METHOD OF AMOUNT OF HEAT RADIATION FROM SHEET

(71) Applicant: Konica Minolta, Inc., Chiyoda-ku, Tokyo (JP)

(72) Inventors: Yuki Yamauchi, Nishitokyo (JP); Hideo Isohara, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/608,727

(22) Filed: Jan. 29, 2015

(65) Prior Publication Data

US 2015/0220053 A1 Aug. 6, 2015

(30) Foreign Application Priority Data

Feb. 3, 2014 (JP) ..... 2014-018281

(51) Int. Cl.

| | |
|---|---|
| ***G03G 21/20*** | (2006.01) |
| ***G03G 15/23*** | (2006.01) |
| ***G03G 15/20*** | (2006.01) |
| ***G03G 15/00*** | (2006.01) |

(52) U.S. Cl.

CPC ..... *G03G 21/20* (2013.01); *G03G 15/238* (2013.01); *G03G 15/6529* (2013.01)

(58) Field of Classification Search

CPC ..... G03G 15/5045; G03G 2215/00772; G03G 2215/1666; G03G 2215/1671; G03G 2215/0059; G03G 2215/00561

See application file for complete search history.

(56) References Cited

U.S. PATENT DOCUMENTS 5,758,227 A * 5/1998 Kopp ..... G03G 15/2003 399/384
2004/0218954 A1* 11/2004 Behnke ..... G03G 15/235 399/401
2014/0029996 A1* 1/2014 Nozawa ..... G03G 21/203 399/388

FOREIGN PATENT DOCUMENTS

JP 2001282053 A 10/2001
JP 2012098477 A 5/2012
JP 2013054186 A 3/2013

OTHER PUBLICATIONS

JP_2012098477_A_T Machine Translation, Japan, Jan. 2014, Nozawa.*

* cited by examiner

*Primary Examiner* — Clayton E Laballe
*Assistant Examiner* — Victor Verbitsky
(74) *Attorney, Agent, or Firm* — Cantor Colburn LLP

(57) ABSTRACT

In an image forming apparatus of a tandem type including an intermediate conveying apparatus which conveys a sheet conveyed from a first image forming apparatus to a second image forming apparatus using a sheet conveying member, there are provided with a detecting portion configured to detect a state of the sheet conveying member, and an adjusting portion configured to adjust the state of the sheet conveying member so that the amount of heat radiation from the sheet in the sheet conveying member becomes constant, according to a detection result of the detecting portion.

24 Claims, 7 Drawing Sheets

IMAGE FORMING SYSTEM, INTERMEDIATE CONVEYING APPARATUS, AND ADJUSTING METHOD OF AMOUNT OF HEAT RADIATION FROM SHEET

CROSS REFERENCES TO RELATED APPLICATIONS

The present invention contains subject matter related to Japanese Patent Application JP 2014-018281, filed in the Japanese Patent Office on Febuary 3, 2014, the entire content of which being incorporated herein by reference.

BACKGROUND OF THE INVENTION

Field of the Invention

The present invention relates to an image forming system of a tandem type serially connecting a plurality of image forming apparatuses, an intermediate conveying apparatus disposed between the image forming apparatuses, and an adjusting method of an amount of heat radiation from a sheet.

Description of the Related Art

There is known an image forming system of a tandem type configured by serially connecting a plurality of (e.g., two) image forming apparatuses (hereinafter, simply called "image forming system"). According to the image forming system, when images are formed on both sides of a sheet, an image can be formed on a front side of the sheet by an image forming apparatus on the upstream side, and an image can be formed on a rear side of the sheet by an image forming apparatus on the downstream side, for example. By causing both of the image forming apparatuses to share the processing of forming the images on the front side and the rear side of the sheet, it is possible to improve productivity compared to a case of forming the images on both sides of the sheet by one image forming apparatus.

Further, according to the image forming system, when different images are formed continuously on the same side of a sheet, it is also possible to form an image by the image forming apparatus on the upstream side and to form another image on the same face of the sheet by the image forming apparatus on the downstream side. By causing both of the image forming apparatuses to share the processing of forming the different images continuously on the same side of the sheet, it is possible also to improve the productivity compared to a case of forming the different images continuously on the same side of the sheet by one image forming apparatus.

In the image forming system, an intermediate conveying apparatus may be disposed between the image forming apparatus on the upstream side and the image forming apparatus on the downstream side, for stably conveying a sheet to the image forming apparatus on the downstream side and for reversing the front and rear sides of a sheet. FIG. 6 shows sheet length change when images are formed continuously on both sides of a plurality of sheets in such an image forming system, and FIG. 6A shows sheet length change at beginning of image formation, and FIG. 6B shows sheet length change after the number of sheets is increased.

The causes of the sheet length change may include thermal contraction of a sheet S having an image (solid-line character "A") formed on the first side of one of the front side and the rear side by the image forming apparatus on the upstream side when the sheet S has passed through a fixing portion within the image forming apparatus on the upstream side, as shown in FIG. 6A. The sheet S is conveyed to the intermediate conveying apparatus in a state that the length (size in the lateral direction of FIG. 6) is shortened due to the thermal contraction.

After that, when the sheet S passes through a sheet conveying member within the intermediate conveying apparatus, a sheet conveying member robs the heat of the sheet S to reduce the temperature of the sheet S, thereby the length is restored by an amount corresponding to the temperature reduction, and then the sheet S is conveyed to the image forming apparatus on the downstream side.

In the image forming apparatus on the downstream side, the size and the position of an image (broken-line character "A") to be formed on the second side which is remaining one of the front side and the rear side are adjusted according to the length of the sheet S conveyed from the intermediate conveying apparatus. Thereby, when the length of the sheet S returns to the original length after the sheet S has passed through a fixing portion of the image forming apparatus on the downstream side to complete image formation, the size and the position of the image formed on the second side come to match those of the image formed on the first side.

When images are formed continuously on a plurality of sheets, however, inside temperature of the intermediate conveying apparatus is raised by heat radiation from the sheet, and an amount of heat to be robbed from the sheet by the sheet conveying member is reduced as the number of sheets is increased. Accordingly, since the temperature reduction amount of the sheet is reduced when the sheet has passed through the intermediate conveying apparatus, as shown in FIG. 6B, the length of the sheet S conveyed from the intermediate conveying apparatus to the image forming apparatus on the downstream side becomes shorter than the length at the beginning of image formation.

As a result, if the size and the position of the image formed on the second side in the image forming apparatus on the downstream side are the same as those in initial adjustment, the size and the position of the image formed on the second side will not match those of the image formed on the first side.

FIG. 7 shows an example of a relationship between an amount of heat radiation from the sheet in the sheet conveying member within the intermediate conveying apparatus and a shift amount between the images on the front side and rear side of the sheet, in the case where images are continuously formed on both sides of a plurality of sheets. The amount of heat radiation from the sheet in the sheet conveying member is reduced and accordingly the shift amount between the image positions on the front side and the rear side of the sheet is increased, as the number of sheets is increased.

Conventionally, there has been proposed a technique of detecting the temperature of a sheet after an image has been formed on the front side, calculating a change amount of the sheet length according to the detection result, and changing a parameter related to an image to be formed on the rear side, as a technique of matching image sizes between the front side and the rear side when images are formed on both sides of the sheet (refer to patent literature 1, for example).

Further, conventionally, in an image forming system of a tandem type, there has been proposed a technique of detecting the temperature of a sheet passing through the intermediate conveying apparatus and cooling the sheet according to the detection result, as a technique of matching process conditions between the image forming apparatus on the upstream side and the image forming apparatus on the downstream side (refer to patent literature 2, for example).

Conventionally, there has been proposed a technique of preventing adhesion of sheets caused by toner melting, by detecting the temperature of the sheet conveying member which the sheet passes through, and cooling the sheet conveying member (refer to patent literature 3, for example).

PRIOR ART DOCUMENT

Patent Literature

Patent literature 1: Japanese Patent Laid Open No. 2001-282053

Patent literature 2: Japanese Patent Laid Open No. 2012-98477

Patent literature 3: Japanese Patent Laid Open No. 2013-54186

SUMMARY OF THE INVENTION

Technical Problem

The technique proposed by above patent literature 1, however, needs to prepare a data table for a relationship between the temperature and the length for each paper type, since the relationship between the temperature and the expansion and contraction amount of the sheet is different depending on the paper type. However, it is difficult for the data table to accommodate all sheets of various paper types desired to be used by users. Further, the technique proposed by patent literature 1 changes a parameter related to an image to be formed, but does not adjust the amount of heat radiation from the sheet in the sheet conveying member.

Further, in the technique proposed by above patent literature 2, it is difficult to perform sufficient cooling for a recent high-speed intermediate conveying apparatus and a sheet having a large heat capacity, and if the cooling is prioritized and sheet conveying speed is reduced, productivity is reduced. Further, the technique proposed by patent literature 2 cools the sheet so as to match process conditions between the image forming apparatus on the upstream side and the image forming apparatus on the downstream side, but does not prevent change in the amount of heat radiation from the sheet in the sheet conveying member within the intermediate conveying apparatus.

Further, also in the technique proposed by above patent literature 3, it is difficult to perform sufficient cooling for the recent high-speed sheet conveying apparatus and a sheet having a large heat capacity, and, if the cooling is prioritized and the sheet conveying speed is reduced, the productivity is reduced. Further, the technique proposed by patent literature 3 cools the sheet conveying member so as to prevent the sheets from adhering to each other by the tonner melting, but does not prevent change in the amount of heat radiation from the sheet in the sheet conveying member.

In view of the conventional problems as described above, an object of the present invention is to prevent change in the amount of heat radiation from the sheet in the sheet conveying member within the intermediate conveying apparatus when images are formed continuously on a plurality of sheets in the image forming system of a tandem type.

Solution to Problem

An image forming system according to one aspect of the present invention is an image forming system of a tandem type having a first image forming apparatus disposed on an upstream side in a sheet conveying direction; a second image forming apparatus disposed on a downstream side in the sheet conveying direction; and an intermediate conveying apparatus which is disposed between the first image forming apparatus and the second image forming apparatus and conveys a sheet conveyed from the first image forming apparatus to the second image forming apparatus using a sheet conveying member, the image forming system including: a detecting portion configured to detect a state of the sheet conveying member in the intermediate conveying apparatus; and an adjusting portion configured to adjust the state of the sheet conveying member so that an amount of heat radiation from the sheet in the sheet conveying member becomes constant, according to a detection result of the detecting portion.

Further, an intermediate conveying apparatus according to one aspect of the present invention is an intermediate conveying apparatus which is disposed between a first image forming apparatus disposed on an upstream side in a sheet conveying direction and a second image forming apparatus disposed on a downstream side in the sheet conveying direction and conveys a sheet conveyed from the first image forming apparatus to the second image forming apparatus using a sheet conveying member, the intermediate conveying apparatus including: a detecting portion configured to detect a state of the sheet conveying member; and an adjusting portion configured to adjust the state of the sheet conveying member so that an amount of heat radiation from the sheet in the sheet conveying member becomes constant, according to a detection result of the detecting portion.

DESCRIPTION OF THE PREFERRED EMBODIMENTS

Hereinafter, examples of a mode for carrying out the present invention will be explained with reference to the attached drawings. Note that a common constituent is provided with the same sign in each of the drawings and duplicated explanation will be omitted.

[Entire Configuration of an Image Forming System]

First, an outline of an image forming system according to an embodiment of the present invention will be explained with reference to FIG. 1.

Figure 1:
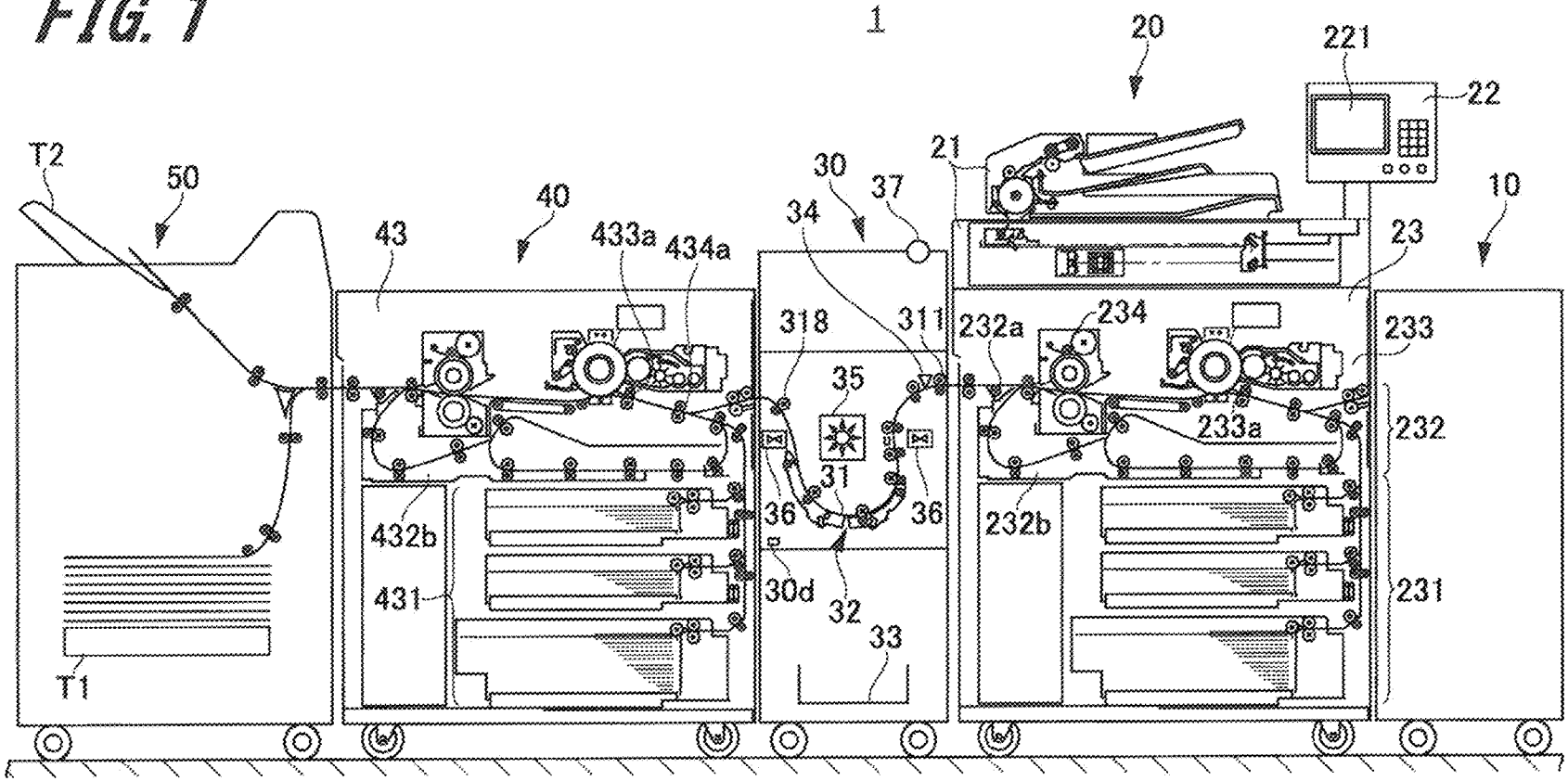
FIG. 1 is a schematic view showing an entire configuration of an image forming system according to an embodiment of the present invention.

FIG. 1 is a schematic view showing an entire configuration of the image forming system according to an embodiment of the present invention.

As shown in FIG. 1, an image forming system 1 has a configuration of a serial tandem type serially linking a paper feeding apparatus 10, a first image forming apparatus 20, an intermediate conveying apparatus 30, a second image forming apparatus 40, a post-processing apparatus 50 and the like from the upstream side in a sheet conveying path.

When the first image forming apparatus 20 and the second image forming apparatus 40 are linked, each of them is set to be either a main machine totally managing the image forming system 1 or a sub-machine operating according to an instruction of the main machine. In the present embodiment, the first image forming apparatus 20 provided on the upstream side in the sheet conveying direction is set to be the main machine, and the second image forming apparatus 40 is set to be the sub-machine.

In the image forming system 1 in the present embodiment, in the case of carrying out a double-sided mode job in which images are formed on both sides of a sheet, the first image forming apparatus 20 functions as a first image forming apparatus performing image formation on one side of the sheet and the second image forming apparatus 40 functions as a second image forming apparatus performing image formation on the other side of the sheet.

When the double-sided mode job is carried out, the first image forming apparatus 20 forms a front-side image on the sheet conveyed from the paper feeding apparatus 10 or a paper feeding portion in the first image forming apparatus 20. Then, the sheet having the image formed on the front-side is subjected to front/rear-side reversal by a reversing portion in the first image forming apparatus 20, and then passes through the intermediate conveying apparatus 30 to be conveyed to the second image forming apparatus 40, and an image is formed on the rear side of the sheet and the sheet is conveyed to the post-processing apparatus 50.

Further, when a one-sided mode job forming an image on one face of a sheet is carried out, the first image forming apparatus 20 forms an image on one face of the sheet conveyed from the paper feeding apparatus 10 or the paper feeding portion in the first image forming apparatus 20. Then, the sheet having the image formed on one side passes through the intermediate conveying apparatus 30 and the second image forming apparatus 40 to be conveyed to the post-processing apparatus 50.

(Paper Feeding Apparatus)

The paper feeding apparatus 10 is called PFU (Paper Feed Unit), and includes a plurality of paper feeding trays, a paper feeding unit configured with a paper feeding roller, a separating roller, a paper feeding/separating rubber, a delivery roller, and the like. Each of the paper feeding trays stores sheets preliminarily classified depending on the type of a sheet (paper type, weight, sheet size, etc.), and the sheets are conveyed one by one from the top of the sheets by the paper feeding unit to a sheet conveying portion of the first image forming apparatus 20. Information about the type of sheet stored in each paper feeding tray (sheet size, paper type, etc.) is stored in a nonvolatile memory 251 to be described below in the first image forming apparatus 20. The paper feeding apparatus 10 functions as a paper feeding portion of the first image forming apparatus 20.

(First Image Forming Apparatus)

The first image forming apparatus 20 reads an image from a document, and performs image formation of the read image on a sheet. Further, the first image forming apparatus 20 receives print data and print setting data of a page description language format such as the PDL (Page Description Language) format and the Tiff format, from an external apparatus or the like, and forms an image on a sheet according to the received print data and print setting data. The first image forming apparatus 20 is configured including an image reading portion 21, an operating-displaying portion 22, a printing portion 23, and the like.

The image reading portion 21 includes an automatic document feeding portion called ADF (Auto Document Feeder) and a reading portion, and reads images of a plurality of documents according to setting information received by the operating-displaying portion 22. The document placed on a document tray of the automatic document feeding portion is conveyed to a contact glass serving as a reading place, and then images on one side or both sides of the document are read by an optical system, and the images of the document is read by a CCD (Charge Coupled Device). Here, the image is not limited to image data such as a figure, a photograph, and the like, and includes text data such as a character, a sign, and the like.

The operating-displaying portion 22 is configured with an LCD (Liquid Crystal Display) 221, a touch panel provided so as to cover the LCD 221, various kinds of switch and button, a ten-key, an operating key group, and the like. The operating-displaying portion 22 receives an instruction from a user and outputs an operation signal thereof to a controlling portion 250 to be described below. Further, the operating-displaying portion 22 displays various kinds of setting screen for inputting various kinds of operation instruction and setting information, and an operation screen for displaying various kinds of processing result and the like, on the LCD 221 according to a display signal input from the controlling portion 250.

The printing portion 23 performs image formation processing of an electro-photographic method, and is configured including various portions related to print output such as a paper feeding portion 231, a sheet conveying portion 232, an image forming portion 233, and a fixing portion 234. Note that, in the printing portion 23 of the present embodiment, while an example of applying the electro-photographic method will be explained, not limited to the example, another printing method may be applied such as an ink-jet method and a heat sublimation method.

The paper feeding portion 231 includes a plurality of paper feeding trays and a paper feeding unit which is configured with a paper feeding roller, a separating roller, a paper feeding/separating rubber, a delivery roller, and the like and provided for each of the paper feeding trays. Each of the paper feeding trays stores sheets to be fed which are preliminarily classified depending on the type of a sheet (paper type, weight, sheet size, and the like) and the sheets are conveyed one by one from the top of the sheets to the sheet conveying portion by the paper feeding unit. Further, information about the type of a sheet stored in each of the paper feeding trays (paper type, weight, sheet size, and the like) is stored in the nonvolatile memory 251.

The sheet conveying portion 232 conveys the sheet conveyed from the paper feeding apparatus 10 or the paper feeding portion 231 onto a sheet conveying path which passes through a plurality of intermediate rollers, a resist roller, and the like to the image forming portion 233. Then, the sheet is conveyed to an image transfer position of the image forming portion 233 and further conveyed to the second image forming apparatus 40. The sheet waits once on the upstream side of a resist roller **233*a* which performs curve correction, and is started to be conveyed again to the downstream side of the resist roller 233***a* according to image formation timing.

Further, the sheet conveying portion 232 includes a reversing portion 232*b* configured with a conveying-path switching portion 232*a*, a reversing roller, and the like. The reversing portion 232*b* conveys the sheet having passed through the fixing portion 234 to the apparatus linked on the downstream side without front/rear-side reversal, or conveys the sheet to the apparatus linked on the downstream side after having switched back the sheet by the reversing roller and the like to reverse the sheet, in response to switching operation of the conveying-path switching portion 232*a*. Further, the reversing portion 232*b* may include a circulation path portion which reverses the front/rear-side of the sheet having passed through the fixing portion 234 and feeds the sheet again to the image forming portion 233 of the first image forming apparatus 20.

The image forming portion 233 includes a photosensitive drum, a charging unit, an exposing unit, a developing unit, a transferring unit, a cleaning unit, and the like, and forms an image on a sheet surface according to the print image data. Note that, when the first image forming apparatus 20 forms a color image, the image forming portion 233 is provided for each of colors (Y, M, C, Bk).

In the image forming portion 233, the exposing unit irradiates the surface of the photosensitive drum which has been charged by the charging unit with light according to the print image data to write an electrostatic latent image on the surface of the photosensitive drum. Then, tonner which is charged by the developing unit is attached to the surface of the photosensitive drum on which the electrostatic latent image is written, to develop the electrostatic latent image. The tonner image attached onto the photosensitive drum is transferred to a sheet at a transfer position. After the toner image has been transferred to the sheet, the cleaning unit removes remaining charge, remaining tonner, and the like on the surface of the photosensitive drum, and a tonner collecting container collects the removed toner and the like.

The fixing portion 234 is configured with a fixing heater, a fixing roller, an external heating portion for fixing, and the like, and heat-fixes the toner image transferred to the sheet.

(Intermediate Conveying Apparatus)

The intermediate conveying apparatus 30 is disposed on the downstream side of the first image forming apparatus 20 and also on the upstream side of the second image forming apparatus 40 in the sheet conveying direction. In the present embodiment, the intermediate conveying apparatus 30 conveys the sheet conveyed from the first image forming apparatus 20 to the second image forming apparatus 40 using a sheet conveying path 31 according to an instruction from the second image forming apparatus 40. The sheet conveying path 31 is configured with a pair of guiding plates (an example of the sheet conveying member) facing each other, and the sheet passes through between the pair of guiding plates.

The length of the sheet conveying path 31 of the intermediate conveying apparatus 30 is formed so that the back end of the sheet does not overlap with the first image forming apparatus 20 when the intermediate conveying apparatus 30 or the second image forming apparatus 40 instructs stop of the sheet within the sheet conveying path 31. The sheet conveying path 31 is configured so as to curve from a position near a conveying roller 311 on the sheet carry-in side to a position near a conveying roller 318 on the sheet carry-out side when viewed from the front side of the intermediate conveying apparatus 30. In the present embodiment, the curve shape (shape of the curved portion) of the sheet conveying path 31 is approximately a U-shape having a convex shape downward. By curving the sheet conveying path 31, it is possible to secure the length of the sheet conveying path 31 in a limited space. In other words, by curving the sheet conveying path 31, it is possible to make the intermediate conveying apparatus 30 smaller while securing the length of the sheet conveying path 31.

Further, the intermediate conveying apparatus 30 includes an automatic path release mechanism 32 which releases the sheet conveying path 31 when jamming occurs. The jamming indicates that the sheet is stopped abnormally by any reason within the image forming system 1. Further, the sheet stopped abnormally in the image forming system 1 is called a jammed sheet, and operation to remove the sheets except the jammed sheet which is stopped abnormally by a user or stopped during conveying (remaining sheets) is called jam processing.

When the jamming occurs in the sheet conveying path 31, the automatic path release mechanism 32 releases apart of the sheet conveying path 31 and thereby the sheet remaining in the sheet conveying path 31 when the jamming occurs is configured to be accommodated into an accommodating portion 33 disposed below the sheet conveying path 31. The intermediate conveying apparatus 30 includes a door open-close detecting sensor 30*d* which detects the open-close state of a front door which is not shown in the drawing and outputs a detection result to the second image forming apparatus 40. The automatic path release mechanism 32 performs the releasing in response to detection of a signal which is output by the door open-close detecting sensor 30*d* and indicates that the front door is opened, for example. When a user removes the jammed sheet and the sheet the conveying of which is stopped within the sheet conveying path 31, that is, when the jam processing is performed, the operation of the image forming system 1 can be started again.

Further, the intermediate conveying apparatus 30 includes a temperature sensor 34 detecting surface temperature of the guiding plate in the sheet conveying path 31 (an example of detecting portion), and a temperature sensor 37 detecting external air temperature (an example of external air temperature detecting portion). Moreover, the intermediate conveying apparatus 30 includes a heater 35 heating the guiding plate (an example of a heating portion which is a constituent of an adjusting portion), and a cooling fan 36 cooling (exhausting) air inside the intermediate conveying apparatus 30 (an example of a cooling portion which is a constituent of the adjusting portion). The temperature sensor 34 is disposed at a position where the guiding plate has a curvature and contacts the sheet (curved portion).

(Second Image Forming Apparatus)

The second image forming apparatus 40 is configured including a printing portion 43 and the like, forms an image on a sheet surface in cooperation with the first image forming apparatus 20.

The sheet conveyed from the first image forming apparatus 20 is conveyed to a resist roller 433*a* via a conveying roller 434*a*. The sheet waits once on the upstream side of the resist roller 433*a*, and starts to be conveyed again to the downstream side of the resist roller 433*a* according to the image formation timing.

Note that the printing portion 43 included in the second image forming apparatus 40 is configured including a sheet conveying portion provided with a paper feeding portion 431 and a reversing portion 432*b*, and various portions related to print output such as an image forming portion, a fixing portion, and the like, similar to the printing portion 23 included in the first image forming apparatus 20, and therefore explanation will be omitted.

(Post-Processing Apparatus)

The post-processing apparatus 50 is disposed on the downstream side of the second image forming apparatus 40 in the sheet conveying direction. The post-processing apparatus 50 includes various kinds of post-processing portion such as a sorting portion, a stapling portion, a punching portion, and a folding portion, a paper ejecting tray (large capacity paper ejection tray T1 and sub-tray T2), and the like, and applies various kinds of processing to the sheet conveyed from the second image forming apparatus 40 and ejects the sheet subjected to the post-processing to the large capacity ejection tray T1 or the sub-tray T2. The large capacity ejection tray T1 has a stage moving up and down, and accommodates a large number of sheets in a state stacked on the stage. In the sub-tray T2, the sheet is exposed to the outside and ejected in a viewable state.

[Configuration of the Controlling System of the Intermediate Conveying Apparatus]

Figure 2:
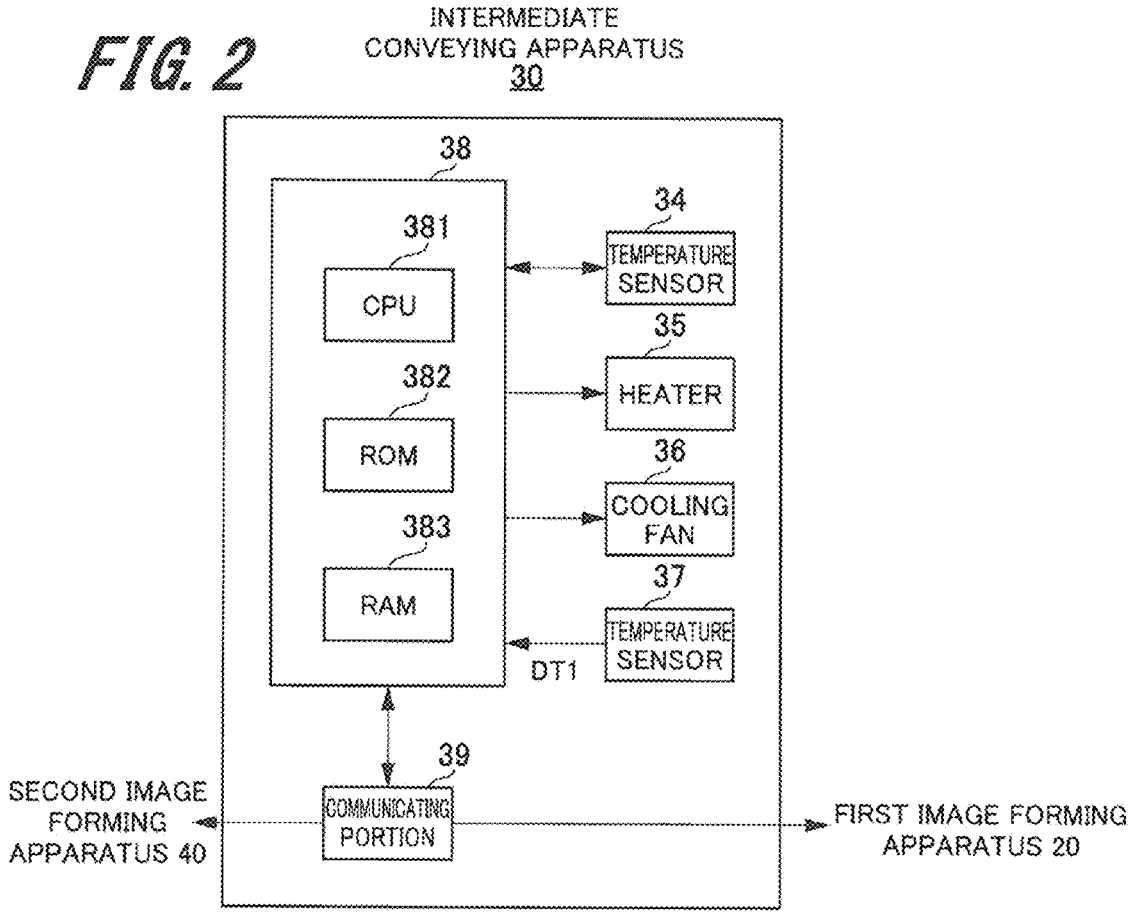
FIG. 2 is a block diagram showing a configuration of a controlling system of an intermediate conveying apparatus in an image forming system according to an embodiment of the present invention.

FIG. 2 is a block diagram showing a configuration of a controlling system of the intermediate conveying apparatus 30 in the image forming system 1.

As shown in FIG. 2, the intermediate conveying apparatus 30 includes a controlling portion 38 (an example of a constituent in the adjusting portion) which controls entire operation of the intermediate conveying apparatus 30. The controlling portion 38 includes a CPU (Central Processing Unit) 381, a ROM (Read Only Memory) 382, and a RAM (Random Access Memory) 383. The ROM 382 stores a program. The CPU 381 realizes the function of the intermediate conveying apparatus 30 by executing the program stored in the ROM 382. The RAM 383 functions as a work area when the CPU 381 executes the program.

The controlling portion 38 is connected with the temperature sensor 34, the heater 35, the cooling fan 36, the temperature sensor 37, and a communicating portion 39.

The temperature sensor 34 detects the temperature of the guiding plate in the sheet conveying path 31, and supplies information indicating the detected temperature to the controlling portion 38. The heater 35 is operated according to a drive signal supplied from the controlling portion 38 to heat the guiding plate. The cooling fan 36 is operated according to a drive signal supplied from the controlling portion 38 to cool the guiding plate. The temperature sensor 37 detects external air temperature and supplies information indicating the detected temperature to the controlling portion 38.

The communicating portion 39 is connected with an un-illustrated communicating portion of the first image forming apparatus 20 and an un-illustrated communicating portion of the second image forming apparatus 40. The communicating portion 39 functions as an inputting-outputting portion establishing a communication with the first image forming apparatus 20 and the second image forming apparatus 40.

[Operation Example of the Intermediate Conveying Apparatus]

Figure 3:
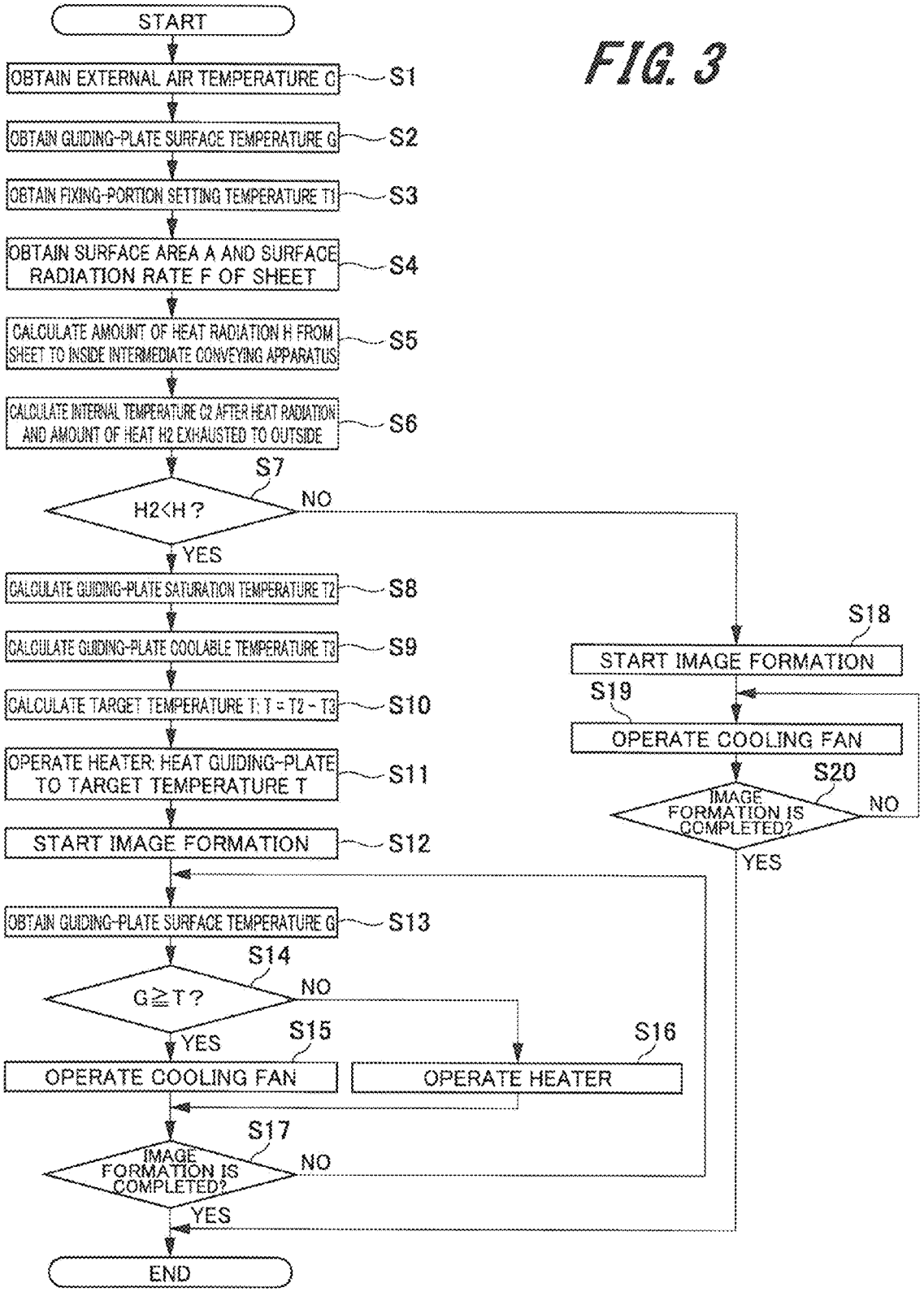
FIG. 3 is a flowchart showing adjustment processing of an amount of heat radiation from a sheet which is carried out by an intermediate conveying apparatus in an embodiment of the present invention.

FIG. 3 is a flowchart showing adjustment processing of the amount of heat radiation from a sheet which is carried out by the controlling portion 38 of the intermediate conveying apparatus 30, when images are formed continuously on a plurality of sheets in the image forming system 1. The controlling portion 38 of the intermediate conveying apparatus 30 realizes processing of the flowchart shown in FIG. 3 by causing the CPU 381 to execute the program stored in the ROM 382.

In the adjustment processing of the amount of heat radiation from the sheet, first the controlling portion 38 obtains information of the external air temperature C (° C.) which is supplied from the temperature sensor 37 (step S1), and obtains information of the surface temperature G (° C.) of the guiding plate in the sheet conveying path 31 which is supplied from the temperature sensor 34 (step S2).

Further, the controlling portion 38 obtains information about setting temperature T1 (° C.) of the fixing portion 234 in the first image forming apparatus 20 from the first image forming apparatus 20 via the communicating portion 39 (step S3). The setting temperature T is a temperature that a user instructed in the operating-displaying portion 22 of the first image forming apparatus 20, for example.

Further, the controlling portion 38 obtains information about a surface area A (m2) of a sheet and a surface radiation rate F of the sheet in the first image forming apparatus 20 from the first image forming apparatus 20 via the communicating portion 39 (step S4). The information about the surface area A and the surface radiation rate F is generated by an un-illustrated controlling portion of the first image forming apparatus 20 according to the sheet size, paper type, weight, and the like which a user instructed in the operating-displaying portion 22 of the first image forming apparatus 20.

Subsequently, the controlling portion 38 calculates an amount of heat H (W) which is radiated from the sheet to inside the intermediate conveying apparatus 30 via the guiding plate of the sheet conveying path 31 (step S5).

The amount of heat H is calculated by formulas as follows. Here, B is the sheet temperature (° C.) which is determined by the setting temperature T1 of the fixing portion 234. Further, D is the thickness (m) of the guiding plate, E is a heat conduction rate (W/mK) of the guiding plate, and J is a convection heat transfer rate (W/m2K) to external air. The information of D, E, and J is stored in the ROM 382. Further, σ is the Stefan-Boltzmann constant.

$$K=\alpha\times A,\ L=\beta\times A,\ H=K+L \qquad \text{[Formula 1]}$$

Subsequently, the controlling portion 38 calculates a temperature C2 (° C.) inside the intermediate conveying apparatus 30 after the amount of heat H (W) has been radiated from the sheet, and an amount of heat H2 (W) exhausted by the cooling fan 36 to outside the intermediate conveying apparatus 30 from inside the intermediate conveying apparatus 30 having the temperature C2 (step S6).

The temperature C2 is calculated by a formula as follows. Here, γ is specific gravity (kg/m3) of the air, c0 is specific heat (J/kg·K) of the air, and L is capacity (m3) inside the intermediate conveying apparatus 30. The information about γ, c0, and L is stored in the ROM 382.

$$C2=H/(\gamma\times c0\times L)+C$$

Further, the amount of heat H2 is calculated by a formula as follows. Here, Q is air flow (m3/sec) of the cooling fan 36. The information about Q is stored in the ROM 382.

$$H2=\gamma\times c0\times Q(c2-C)$$

Subsequently, the controlling portion 38 determines whether or not the amount of heat H2 is smaller than the amount of heat H, that is, whether or not the cooling capability of the cooling fan 36 is insufficient for the amount of heat radiated from the sheet to inside the intermediate conveying apparatus 30 (step S7).

When the amount of heat H2 is smaller than the amount of heat H, the controlling portion 38 calculates a saturation temperature T2 of the guiding plate according to the external air temperature C and information about the material of the guiding plate in the sheet conveying path 31 which is stored in the ROM 382 (step S8).

Further, the controlling portion 38 calculates a coolable temperature T3 of the guiding plate which is a temperature at which the cooling fan 36 can cool the guiding plate while one sheet passes through inside the intermediate conveying apparatus 30 (step S9).

The coolable temperature T3 of the guiding plate is calculated by a formula as follows. Here, t is time (sec) required for one sheet to pass through inside the intermediate conveying apparatus 30, m1 is mass (kg) of the guiding plates, and c1 is specific heat (J/kg·K) of the guiding plate. The time t is obtained by acquiring information about conveying speed of the sheet from the first image forming apparatus 20 via the communicating portion 39, and dividing the total length of the guiding plate stored in the ROM 382 by the conveying speed. Further, information about the mass m1 and the specific heat c1 is stored in the ROM 382.

$$T3=(H2\times t)/m1\times c1$$

Subsequently, the controlling portion 38 sets a temperature T2-T3 which is obtained by subtracting the coolable temperature T3 of the guiding plate from the saturation temperature T2, as a target temperature T of the guiding plate (step S10). The target temperature T is a temperature at which the amount of heat radiation from the sheet to the guiding plate becomes equal to an amount of heat corresponding to the temperature at which the cooling fan 36 can cool the guiding plate. Then, the controlling portion 38 operates the heater 35 and heats the guiding plate to thereby raise the temperature of the guiding plate up to the target temperature T (step S11).

Subsequently, the controlling portion 38 transmits information instructing the start of image formation to the first image forming apparatus 20 and the second image formation apparatus 40 via the communicating portion 39 (step S12). When the image formation is started, the controlling portion 38 obtains the information supplied from the temperature sensor 34 about the surface temperature G of the guiding plate in the sheet conveying path 31 (step S13), and determines whether or not the surface temperature G is equal to or higher than the target temperature T (step S14).

When the surface temperature G is equal to or higher than the target temperature T, the controlling portion 38 operates the cooling fan 36 to cool the guiding plate (step S15). On the other hand, when the surface temperature G is lower than the target temperature T, the controlling portion 38 operates the heater 35 to heat the guiding plate (step S16).

Then, the controlling portion 38 repeats steps S13 to S16 until receiving information indicating that the image formation has been completed, from the first image forming apparatus 20 and the second image forming apparatus 40 via the communicating portion 39 (step S17), and when the image formation is completed, the adjustment processing of the amount of heat radiation from the sheet is finished.

In step S7, when the amount of heat H2 is not smaller than the amount of heat H, the controlling portion 38 transmits the information instructing the start of the image formation to the first image forming apparatus 20 and the second image forming apparatus 40 via the communicating portion 39 (step S18). When the image formation is started, the controlling portion 38 operates the cooling fan 36 to cool the guiding plate (step S19). Then, the controlling portion 38 repeats step S19 until receiving information indicating that the image formation has been completed from the first image forming apparatus 20 and the second image forming apparatus 40 via the communicating portion 39 (step S20). When the image formation is completed, the adjustment processing of the amount of heat radiation from the sheet is finished.

Figure 4:
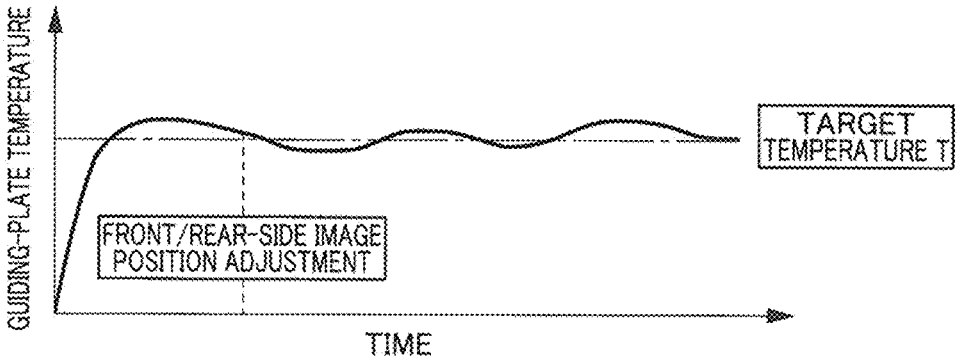
FIG. 4 is a diagram showing a state of temperature adjustment of a guiding plate during image formation in an embodiment of the present invention.

FIG. 4 is a diagram showing a state of the temperature adjustment in the guiding plate of the sheet conveying path 31 during the image formation, when steps S8 to S17 of the processing in FIG. 3 are executed. The temperature of the guiding plate keeps the target temperature T even when time elapses and the number of stacked sheets is increased, by repeating steps S13 to S16 after the temperature of the guiding plate has been raised to the target temperature T in step S11.

Figure 5:
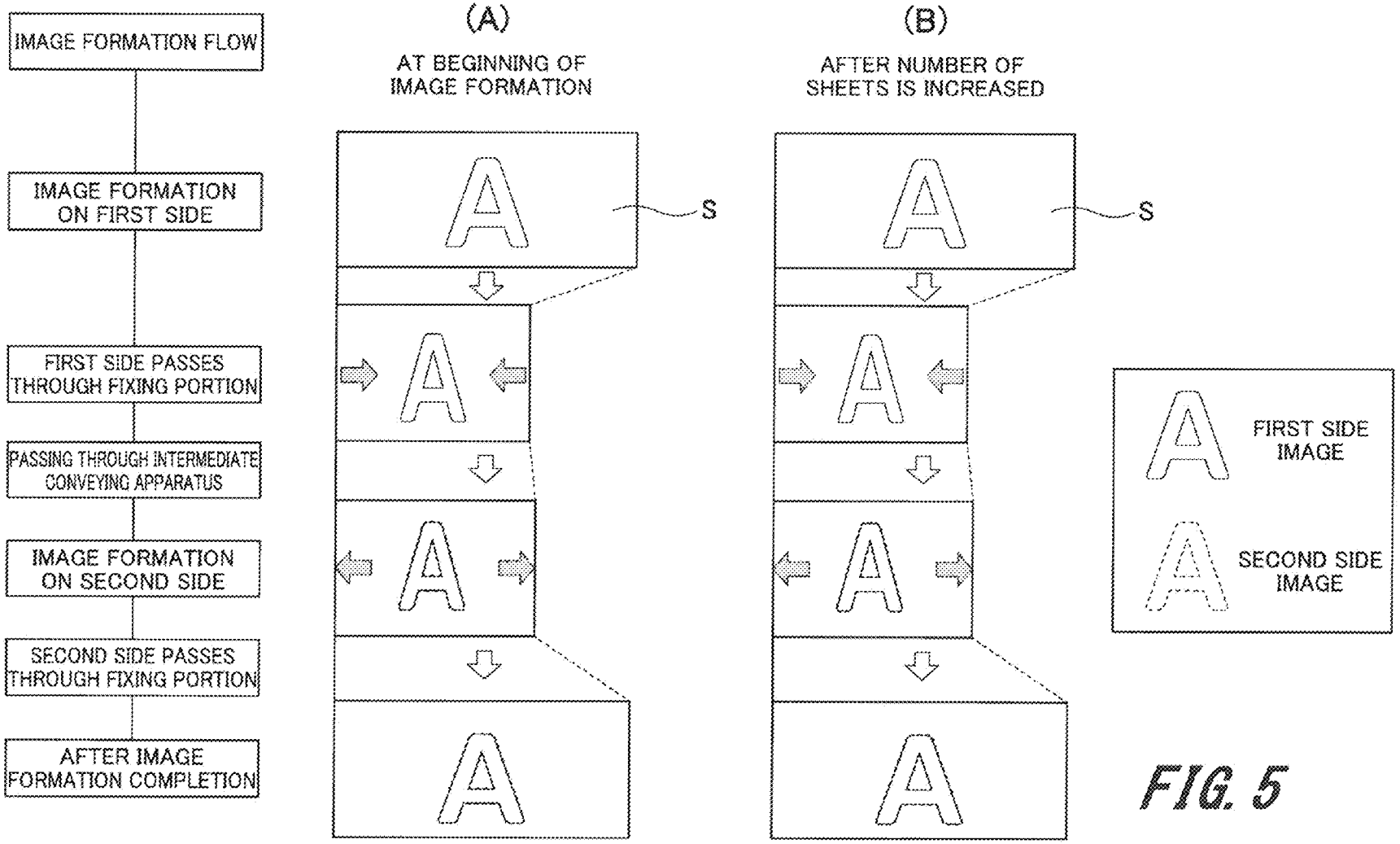
FIG. 5 is a diagram showing sheet length change during image formation in an embodiment of the present invention.
Figure 6:
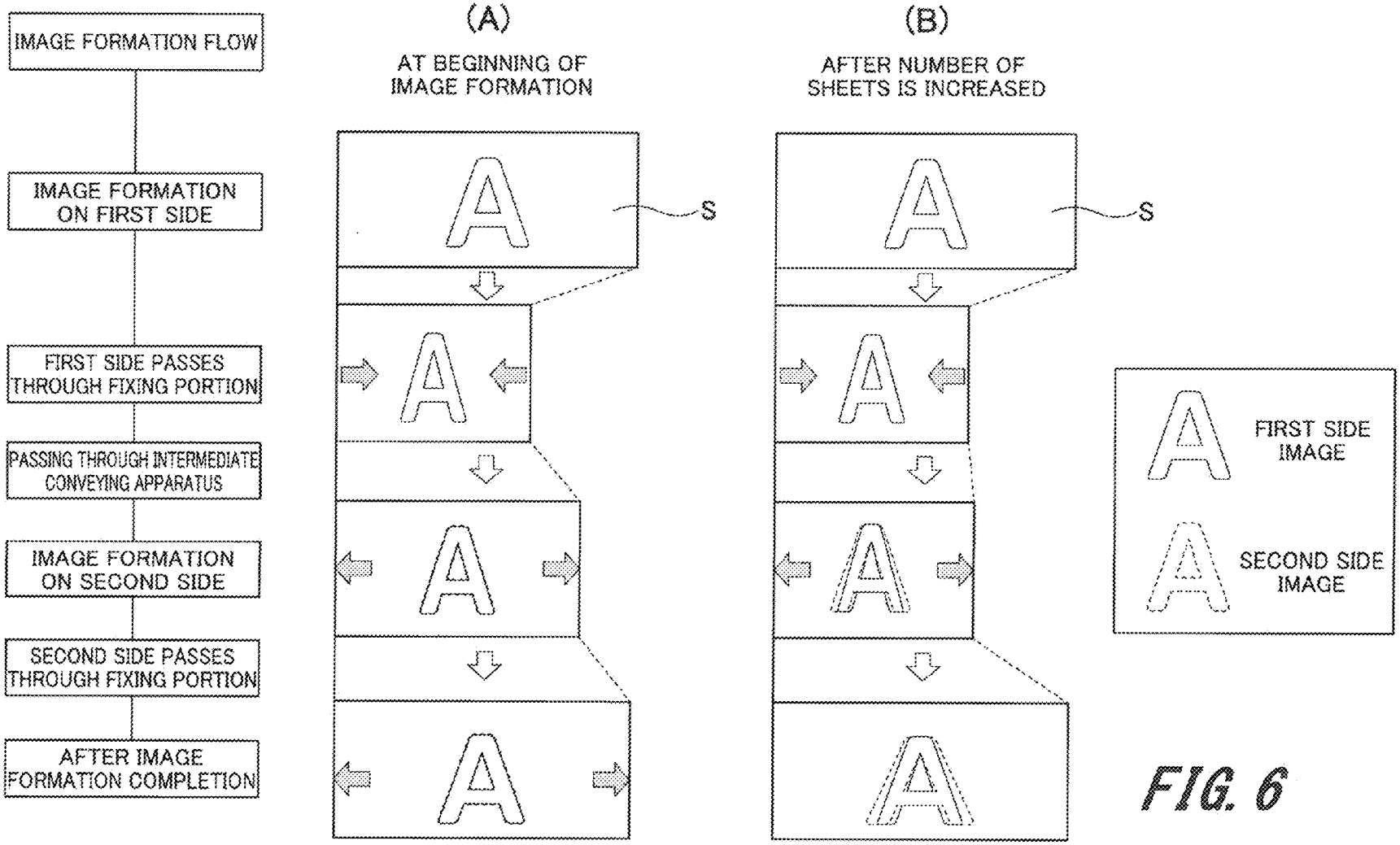
FIG. 6 is a diagram showing sheet length change during image formation in a prior art.
Figure 7:
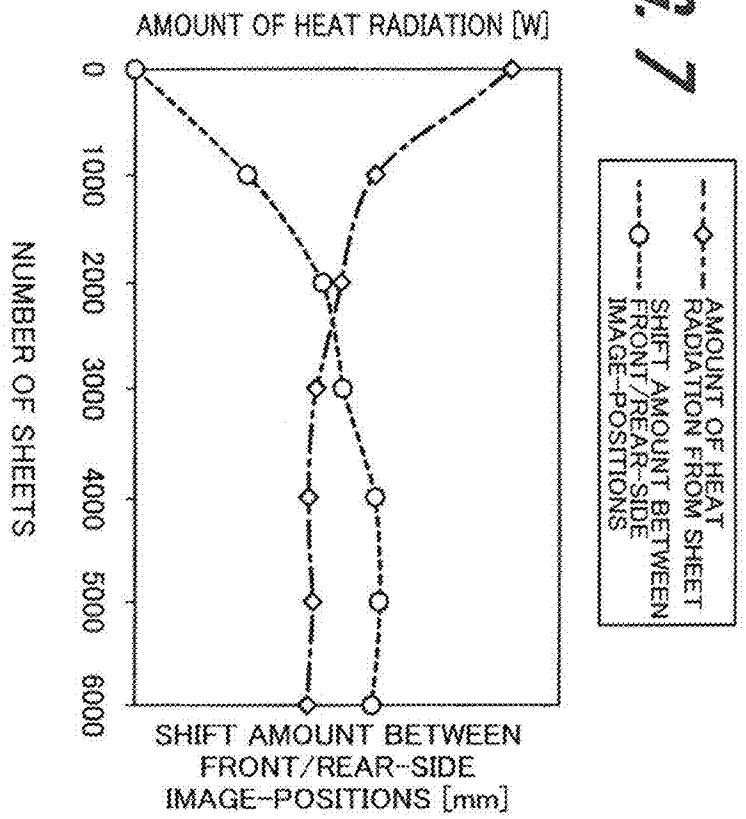
FIG. 7 is a diagram showing a relationship of an amount of heat radiation and a position shift amount of a sheet with the number of sheets in a prior art.

FIG. 5 shows the sheet length change as in FIG. 6 when steps S8 to S17 in the processing of FIG. 3 are carried out in the case that images are formed continuously on both sides of a plurality of sheets, and FIG. 5A shows the sheet length change at the beginning of image formation and FIG. 5B shows the sheet length change after the number of stacked sheets is increased.

As shown in FIG. 5A, a sheet S having an image (solid-line character "A") formed on the first side which is one of the front side and the rear side in the first image forming apparatus 20 is conveyed to the intermediate conveying apparatus 30 in a state where the length (size in the lateral direction of FIG. 5) is shortened due to the thermal contraction when passing through the fixing portion 234 in the first image forming apparatus 20.

After that, the sheet S passes through the guiding plate of the sheet conveying path 31 in the intermediate conveying apparatus 30. At this time, since the surface temperature of the guiding plate is raised to the target temperature T by step S11 in the processing of FIG. 3, and the amount of heat radiated from the sheet S to inside the intermediate conveying apparatus 30 is limited to a small amount (only amount of heat corresponding to the coolable temperature T3 in the guiding plate) from the beginning of image formation. Accordingly, the temperature reduction amount of the sheet S is small when the sheet S passes through the intermediate conveying apparatus 30, and therefore the restored amount in the length of the sheet S becomes small. Accordingly, compared with the prior art shown in FIG. 6A, the length of the sheet S conveyed from the intermediate conveying apparatus 30 to the second image forming apparatus 40 becomes small.

The second image forming apparatus 40 adjusts the size and the position of an image (broken-line character "A") to be formed on the second side which is remaining one of the front side and the rear side according to the length of the sheet S. Note that also FIG. 4 shows the adjustment of the size and the position with respect to the target temperature as "front/rear-side image position adjustment". Thereby, when the length of the sheet S returns to the original length after the sheets S has passed through the fixing portion in the second image forming apparatus 40 and the image formation has been completed, the size and the position of the image formed on the second face will match those of the image formed on the first face.

After that, since the surface temperature of the guiding plate in the sheet conveying path 31 keeps the target temperature T by steps S13 to S16 in the processing of FIG. 3 even when the number of stacked sheets is increased, the amount of heat radiated from the sheet to inside the intermediate conveying apparatus 30 does not change but becomes constant. Accordingly, as shown in FIG. 5B, the length of the sheet S conveyed from the intermediate conveying apparatus 30 to the second image forming apparatus 40 does not change from that at the beginning of image formation, even when the number of stacked sheets is increased.

Thereby, when the size and the position of the image to be formed on the second side in the second image forming apparatus 40 are kept to be the same as those in the initial adjustment, the size and the position of the image formed on the second side will match those of the image formed on the first side even after the number of stacked sheets has been increased.

Note that, when the amount of heat H2 is equal to or higher than the amount of heat H in step S7 in the processing of FIG. 3, it is possible to exhaust the whole amount of heat radiated from the sheet to inside the intermediate conveying apparatus 30, to outside the intermediate conveying apparatus 30 by the cooling fan 36, only by operating the cooling fan 36 in step S19. Accordingly, also in the above case, when the size and the position of the image to be formed on the second side in the second image forming apparatus 40 are kept to be the same as those in the initial adjustment, the size and the position of the image formed on the second side will match those of the image formed on the first face even after the number of stacked sheets has been increased.

As explained above, in the image forming system according to the embodiment, the temperature of the guiding plate is adjusted so that the amount of heat radiation from the sheet to the guiding plate does not change but becomes constant, according to the detection result of the temperature in the guiding plate (an example of a state of the sheet conveying member) of the sheet conveying path 31 in the intermediate conveying apparatus 30. Accordingly, when images are formed continuously on a plurality of sheets, the temperature reduction amount of the sheet becomes constant when the sheet has passed through the intermediate conveying apparatus 30, even after the number of stacked sheets has been increased, and the length of the sheet conveyed from the intermediate conveying apparatus 30 to the second image forming apparatus 40 becomes constant. Thereby, when the size and the position of the image to be formed in the second image forming apparatus 40 are kept to be the same as those in the initial adjustment of the image formation, the size and the position of the image formed in the second image forming apparatus 40 will match those of the image formed in the first image forming apparatus 20 even after the number of stacked sheets has been increased.

Further, the amount of heat radiation from the sheet to the guiding plate is limited to a small amount by performing heating, which has better efficiency than cooling and can be realized by a simple configuration, on the guiding plate of the sheet conveying path 31 to preliminarily raise the temperature of the guiding plate, before the start of the image formation. Accordingly, it is possible to keep the temperature of the guiding plate to a high temperature so that the amount of heat radiation from the sheet to the guiding plate becomes constant while keeping the above limited small amount, after the start of the image formation, even when using a simple cooling fan having a not so high cooling capability as the cooling fan 36. Further, since it is not necessary to reduce the conveying speed for prioritizing the cooling, the problem of the productivity reduction does not arise.

Further, since the target temperature of the guiding plate is calculated by the use of the detection result of the external air temperature by the temperature sensor 37, and the temperature of the guiding plate is raised to the target temperature, it is possible to raise the temperature of the guiding plate to an appropriate temperature according to the external air temperature and the cooling capability of the cooling fan 36.

Further, since the temperature sensor 34 detecting the surface temperature of the guiding plate in the sheet conveying path 31 is disposed at a position where the guiding plate has the curvature and contacts the sheet (curved portion), it is possible to appropriately detect the temperature change of the guiding plate caused by the passing of the sheet after the start of the image formation, and to keep the temperature of the guiding plate at the target temperature.

Further, the information about the surface area A and surface radiation rate F of the sheet which the intermediate conveying apparatus 30 obtains from the first image forming apparatus 20 is generated according to the size, paper type, weight, and the like of the sheet designated by the user on the side of the first image forming apparatus 20. Accordingly, the sizes and the positions can be matched between the image formed by the first image forming apparatus 20 and the image formed by the second image forming apparatus 40 corresponding to the sheet having various sizes, paper types, weights, and the like which the user want to use.

Variation Examples

While an embodiment of the present invention has been explained above, the present invention is not limited to the above embodiment, and can be modified variously within a range without departing from the gist of the invention described in claims.

For example, the above embodiment explains an example of disposing the intermediate conveying apparatus 30 which does not have a function of reversing the front/rear-side of a sheet between the first image forming apparatus 20 and the second image forming apparatus 40. In another example, however, the present invention may be applied to an image forming system disposing an intermediate conveying apparatus which has a function of reversing the front/rear-side of a sheet between a first image forming apparatus on the upstream side and a second image forming apparatus on the downstream side. Alternatively, the present invention may be applied to an image forming system disposing both of an intermediate conveying apparatus which has a function of the front/rear-side reversal and an intermediate conveying apparatus which does not have the function of the front/rear-side reversal, between a first image forming apparatus on the upstream side and a second image forming apparatus on the downstream side.

Further, the above embodiment explains an example of heating the guiding plate of the sheet conveying path 31 using the heater 35 to raise the temperature of the guiding plate before the start of the image formation. In another example, however, before the start of the image formation, a plurality of sheets of white papers heated by the fixing portion 234 of the first image forming apparatus 20 may be conveyed to the intermediate conveying apparatus 30 to pass through inside the intermediate conveying apparatus 30, the guiding plate may be heated by the radiation heat from the sheets of white papers, and thereby the temperature of the guiding plate may be raised.

DESCRIPTION OF SIGNS

1 . . . Image forming system, 20 . . . First image forming apparatus, 23 . . . Printing portion, 233 . . . Image foming portion, 234 . . . Fixing portion, 30 . . . Intermediate conveying apparatus, 31 . . . Sheet conveying path, 34 . . .

Temperature sensor, 35 . . . Heater, 36 . . . Cooling fan, 37 . . . Temperature sensor, 38 . . . Controlling portion, 381 . . . CPU, 382 . . . ROM, 383 . . . RAM, 39 . . . Communicating portion, 40 . . . Second image forming apparatus, 43 . . . Printing portion

What is claimed is:

1. An image forming system of a tandem type comprising:

a first image forming apparatus disposed on an upstream side in a sheet conveying direction;

a second image forming apparatus disposed on a downstream side in the sheet conveying direction; and an intermediate conveying apparatus which is disposed between the first image forming apparatus and the second image forming apparatus and conveys a sheet conveyed from the first image forming apparatus to the second image forming apparatus using a sheet conveying member, wherein when forming images on both sides of a sheet, the first image forming apparatus forms an image on one side of the sheet and the second image forming apparatus forms an image on the other side of the sheet, and the image forming system further comprising:

a first detecting portion that detects a temperature of the sheet conveying member in the intermediate conveying apparatus;

a second detecting portion that detects an external air temperature of the intermediate conveying apparatus; and an adjusting portion that calculates a target temperature of the sheet conveying member using a detection result of the second detecting portion, and adjusts the temperature of the sheet conveying member so as to be kept at the target temperature, according to a detection result of the first detecting portion, such that a size of the image formed on one side of the sheet by the first image forming apparatus matches a size of the image formed on the other side of the sheet by the second image forming apparatus.

2. The image forming system according to claim 1, wherein the adjusting portion includes a heating portion, and causes the heating portion to heat the sheet conveying member to raise the temperature of the sheet conveying member, before start of image formation in the first image forming apparatus and the second image forming apparatus, to the target temperature.

3. The image forming system according to claim 2, wherein the adjusting portion further includes a cooling portion, and causes at least one of the cooling portion and the heating portion to operate and keeps the temperature of the sheet conveying member at the target temperature, after the start of image formation in the first image forming apparatus and the second image forming apparatus.

4. The image forming system according to claim 3, wherein the adjusting portion calculates the target temperature by subtracting a coolable temperature of the sheet conveying member from a saturation temperature of the sheet conveying member, the coolable temperature being a temperature at which the sheet conveying member can be cooled by the cooling portion while one sheet conveyed from the first image forming apparatus to the second image forming apparatus passes through inside the intermediate conveying apparatus, and the saturation temperature being calculated according to the external air temperature of the intermediate conveying apparatus detected by the second detecting portion and information about material of the sheet conveying member stored in a memory of the adjusting portion.

5. The image forming system according to claim 1, wherein the sheet conveying member is a member having a shape including a curved portion, and the first detecting portion detects a temperature of the curved portion as the temperature of the sheet conveying member.

6. The image forming system according to claim 1, wherein the first image forming apparatus is configured to heat each sheet on which an image has been formed to fix the image onto the sheet and convey the heated sheet to the intermediate conveying apparatus, where the heated sheet radiates heat on the sheet conveying member of the intermediate conveying apparatus, and then the sheet is conveyed from the intermediate conveying apparatus to the second image forming apparatus.

7. The image forming system according to claim 1, wherein the adjusting portion is configured to calculate a first amount of heat, based on the sheet surface radiation rate in the first image forming apparatus, which is radiated from the sheet to inside the intermediate conveying apparatus and to calculate a second amount of heat which is exhausted to outside the intermediate conveying apparatus by a cooling portion, and compare the first amount of heat with the second amount of heat.

8. The image forming system according to claim 1, wherein the adjusting portion calculates the target temperature by subtracting a coolable temperature of the sheet conveying member from a saturation temperature of the sheet conveying member, the coolable temperature being a temperature at which the sheet conveying member can be cooled by the cooling portion while one sheet conveyed from the first image forming apparatus to the second image forming apparatus passes through inside the intermediate conveying apparatus, and the saturation temperature being calculated according to the external air temperature of the intermediate conveying apparatus detected by the second detecting portion and information about material of the sheet conveying member stored in a memory of the adjusting portion.

9. An intermediate conveying apparatus which is disposed between a first image forming apparatus disposed on an upstream side in a sheet conveying direction and a second image forming apparatus disposed on a downstream side in the sheet conveying direction and conveys a sheet conveyed from the first image forming apparatus to the second image forming apparatus using a sheet conveying member, wherein when forming images on both sides of a sheet, the first image forming apparatus forms an image on one side of the sheet and the second image forming apparatus forms an image on the other side of the sheet, the intermediate conveying apparatus comprising:

a first detecting portion that detects a temperature of the sheet conveying member;

a second detecting portion that detects an external air temperature of the intermediate conveying apparatus; and an adjusting portion that calculates a target temperature of the sheet conveying member using a detection result of the second detecting portion, and adjusts the temperature of the sheet conveying member so as to be kept at the target temperature, according to a detection result of the first detecting portion, such that a size of the image formed on one side of the sheet by the first image forming apparatus matches a size of the image formed on the other side of the sheet by the second image forming apparatus.

10. The intermediate conveying apparatus according to claim 9, wherein the adjusting portion includes a heating portion, and causes the heating portion to heat the sheet conveying member to raise the temperature of the sheet conveying member, before start of image formation in the first image forming apparatus and the second image forming apparatus, to the target temperature.

11. The intermediate conveying apparatus according to claim 10, wherein the adjusting portion further includes a cooling portion, and causes at least one of the cooling portion and the heating portion to operate and keeps the temperature of the sheet conveying member at the target temperature, after the start of image formation in the first image forming apparatus and the second image forming apparatus.

12. The intermediate conveying apparatus according to claim 11, wherein the adjusting portion calculates the target temperature by subtracting a coolable temperature of the sheet conveying member from a saturation temperature of the sheet conveying member, the coolable temperature being a temperature at which the sheet conveying member can be cooled by the cooling portion while one sheet conveyed from the first image forming apparatus to the second image forming apparatus passes through inside the intermediate conveying apparatus, and the saturation temperature being calculated according to the external air temperature of the intermediate conveying apparatus detected by the second detecting portion and information about material of the sheet conveying member stored in a memory of the adjusting portion.

13. The intermediate conveying apparatus according to claim 9, wherein the sheet conveying member is a member having a shape including a curved portion, and the first detecting portion detects a temperature of the curved portion as the temperature of the sheet conveying member.

14. The intermediate conveying apparatus according to claim 9, wherein the first image forming apparatus is configured to heat each sheet on which an image has been formed to fix the image onto the sheet and convey the heated sheet to the intermediate conveying apparatus, where the heated sheet radiates heat on the sheet conveying member of the intermediate conveying apparatus, and then the sheet is conveyed from the intermediate conveying apparatus to the second image forming apparatus.

15. The intermediate conveying apparatus according to claim 9, wherein the adjusting portion is configured to calculate a first amount of heat, based on the sheet surface radiation rate in the first image forming apparatus, which is radiated from the sheet to inside the intermediate conveying apparatus and to calculate a second amount of heat which is exhausted to outside the intermediate conveying apparatus by a cooling portion, and compare the first amount of heat with the second amount of heat.

16. The intermediate conveying apparatus according to claim 9, wherein the adjusting portion calculates the target temperature by subtracting a coolable temperature of the sheet conveying member from a saturation temperature of the sheet conveying member, the coolable temperature being a temperature at which the sheet conveying member can be cooled by the cooling portion while one sheet conveyed from the first image forming apparatus to the second image forming apparatus passes through inside the intermediate conveying apparatus, and the saturation temperature being calculated according to the external air temperature of the intermediate conveying apparatus detected by the second detecting portion and information about material of the sheet conveying member stored in a memory of the adjusting portion.

17. An adjusting method of an amount of heat radiation from a sheet in an intermediate conveying apparatus which is disposed between a first image forming apparatus disposed on an upstream side in a sheet conveying direction and a second image forming apparatus disposed on a downstream side in the sheet conveying direction and conveys a sheet conveyed from the first image forming apparatus to the second image forming apparatus using a sheet conveying member wherein when forming images on both sides of a sheet, the first image forming apparatus forms an image on one side of the sheet and the second image forming apparatus forms an image on the other side of the sheet, the adjusting method comprising:

detecting a temperature of the sheet conveying member by a first detecting portion, detecting an external air temperature of the intermediate conveying apparatus by a second detecting portion, and calculating a target temperature of the sheet conveying member using a detection result of the second detecting portion and adjusting the temperature of the sheet conveying member so as to be kept at the target temperature, according to a detection result of the first detecting portion, by an adjusting portion, such that a size of the image formed on one side of the sheet by the first image forming apparatus matches a size of the image formed on the other side of the sheet by the second image forming apparatus.

18. The adjusting method of an amount of heat radiation from a sheet according to claim 17, wherein the adjusting portion includes a heating portion, and causes the heating portion to heat the sheet conveying member to raise the temperature of the sheet conveying member, before start of image formation in the first image forming apparatus and the second image forming apparatus, to the target temperature.

19. The adjusting method of an amount of heat radiation from a sheet according to claim 18, wherein the adjusting portion further includes a cooling portion, and causes at least one of the cooling portion and the heating portion to operate and keeps the temperature of the sheet conveying member at the target temperature, after the start of image formation in the first image forming apparatus and the second image forming apparatus.

20. The adjusting method of an amount of heat radiation from a sheet according to claim 19, wherein the adjusting portion calculates the target temperature by subtracting a coolable temperature of the sheet conveying member from a saturation temperature of the sheet conveying member, the coolable temperature being a temperature at which the sheet conveying member can be cooled by the cooling portion while one sheet conveyed from the first image forming apparatus to the second image forming apparatus passes through inside the intermediate conveying apparatus, and the saturation temperature being calculated according to the external air temperature of the intermediate conveying apparatus detected by the second detecting portion and information about material of the sheet conveying member stored in a memory of the adjusting portion.

21. The adjusting method of an amount of heat radiation from a sheet according to claim 17, wherein the sheet conveying member is a member having a shape including a curved portion, and the first detecting portion detects a temperature of the curved portion as the temperature of the sheet conveying member.

22. The adjusting method of an amount of heat radiation from a sheet according to claim 17, wherein the first image forming apparatus is configured to heat each sheet on which an image has been formed to fix the image onto the sheet and convey the heated sheet to the intermediate conveying apparatus, where the heated sheet radiates heat on the sheet conveying member of the intermediate conveying apparatus, and then the sheet is conveyed from the intermediate conveying apparatus.

23. The adjusting method of an amount of heat radiation from a sheet according to claim 17, wherein the adjusting portion calculates a first amount of heat, based on the sheet surface radiation rate in the first image forming apparatus, which is radiated from the sheet to inside the intermediate conveying apparatus and to calculate a second amount of heat which is exhausted to outside the intermediate conveying apparatus by a cooling portion, and compare the first amount of heat with the second amount of heat.

24. The adjusting method of an amount of heat radiation from a sheet according to claim 17, wherein the adjusting portion calculates the target temperature by subtracting a coolable temperature of the sheet conveying member from a saturation temperature of the sheet conveying member, the coolable temperature being a temperature at which the sheet conveying member can be cooled by the cooling portion while one sheet conveyed from the first image forming apparatus to the second image forming apparatus passes through inside the intermediate conveying apparatus, and the saturation temperature being calculated according to the external air temperature of the intermediate conveying apparatus detected by the second detecting portion and information about material of the sheet conveying member stored in a memory of the adjusting portion.

* * * * *